US005540069A

United States Patent [19]

Muller et al.

[11] Patent Number: 5,540,069

[45] Date of Patent: Jul. 30, 1996

[54] ELECTRONIC AND MECHANICAL LOCK AND KEY THEREFOR

[75] Inventors: Pierre-Emmanuel Muller, Paris; Frédéric Wehowski, Gretz Armainvilliers; Roland Arzul, Saint-Valery-sur-Somme; Yves Allart, Abbeville, all of France

[73] Assignee: Vachette, Paris, France

[21] Appl. No.: 50,337

[22] PCT Filed: Nov. 12, 1991

[86] PCT No.: PCT/FR91/00883

§ 371 Date: Aug. 19, 1993

§ 102(e) Date: Aug. 19, 1993

[87] PCT Pub. No.: WO92/08864

PCT Pub. Date: May 29, 1992

[30] Foreign Application Priority Data

Nov. 16, 1990 [FR] France ..... 90 14270

[51] Int. Cl.[6] ..... E05B 49/00

[52] U.S. Cl. ..... 70/278; 70/283; 340/825.31

[58] Field of Search ..... 70/278, 283, 277, 70/279–282; 340/825.31, 825.56

[56] References Cited

U.S. PATENT DOCUMENTS

| | | | |
|---|---|---|---|
| 4,148,372 | 4/1979 | Schroeder | 180/114 |
| 4,392,133 | 7/1983 | Lundgren | 340/825.31 |
| 4,646,080 | 2/1987 | Genest et al. | 340/825.31 |
| 4,789,859 | 12/1988 | Clarkson et al. | 340/825.31 |
| 4,791,280 | 12/1988 | O'Connell et al. | 340/825.31 X |
| 4,868,409 | 9/1989 | Tanaka et al. | 70/278 X |
| 4,909,053 | 3/1990 | Zipf, III et al. | 70/283 |
| 4,953,375 | 9/1990 | Tzou | 70/441 |
| 4,967,576 | 11/1990 | Warfman | 70/63 |
| 5,359,322 | 10/1994 | Murray | 340/825.31 |
| 5,387,903 | 2/1995 | Cutter et al. | 340/825.31 |

FOREIGN PATENT DOCUMENTS

| | | | |
|---|---|---|---|
| 0329931 | 8/1989 | European Pat. Off. | 70/278 |
| 3006128 | 8/1981 | Germany . | |
| 3724407 | 4/1989 | Germany . | |
| 2225371 | 5/1990 | United Kingdom | 70/277 |

OTHER PUBLICATIONS

Phillips, Bill, Kaba Nova: A Self–Contained System With No Hardwiring, Access Control, Locksmith Ledger–Apr. 1989, pp. 62–64.

*Primary Examiner*—Lloyd A. Gall
*Attorney, Agent, or Firm*—Pollock, Vande Sande & Priddy

[57] ABSTRACT

A locking device including both a mechanical lock operable with a key and an electrical lock, operable from the same key. The device includes an electrical circuit for operating the electrical lock. The electrical circuit has a microprocessor and memory which stores the identity of keys authorized to open both the mechanical lock and electrical lock. A master key is provided which includes at one end a connector which engages a connector within the mechanical lock when inserted. Information is read from the master key, identifying a set of keys which are authorized to open the lock. Whenever a key from the set of authorized keys is inserted in the lock, an identification number is read through a contact member from a memory associated with the key, and an electrical signal is generated by the electric circuit of the lock to operate the electrical lock.

10 Claims, 5 Drawing Sheets

ELECTRONIC AND MECHANICAL LOCK AND KEY THEREFOR

The invention concerns an electronic and mechanical lock of the type that comprises means of mechanical blocking and means of electromagnetic blocking capable of being controlled by electronic circuitry in the lock. The lock is designed to be controlled by a key comprising a mechanical variant capable of releasing the mechanical part of the lock, and an electronic data storage element that can be read by the electronic circuitry in the lock to avoid the electromagnetic blocking of the lock when the key is authorized.

A lock of this type is described in FR-A-2 655 367 submitted on Dec. 5, 1989 under number 89 16039 in the name of the same applicant. A corresponding key is described in patent application FR 89 16038 of the same date, in the name of the same applicant, published under number FR-A-2 655 368.

The purpose of the invention is essentially to provide an electronic and mechanical lock that is simple and practical to use, that can be adapted and fitted to as many types of doors as possible, that will ensure the fullest possible security for its purchaser, and that will allow the latter to modify the key authorizations or exclusions easily.

SUMMARY OF THE INVENTION

In accordance with the invention an electronic and mechanical lock of the type defined above is characterized by the fact that its electronic circuitry comprises a memory for the storage of a customer code, assigned to the purchaser and so constituted that it can be combined with a set of keys supplied to the purchaser of the lock. The set of keys comprises:

keys referred to as "normal" including the appropriate mechanical variant, together with a customer code identical to that of the corresponding lock. Each of these normal keys also comprises electronic data corresponding to an identification code specific to the key itself, notably consisting of a number; and and one master-key is supplied, which will not open the lock, but which will allow the purchaser, when this master-key has been inserted into the lock, either to program the lock so as to authorize or exclude the identification codes of the normal keys, which will then be respectively able or unable to open the lock, or to deactivate the electronic circuitry of the lock so that the lock will operate in a purely mechanical way.

For preference, the electronic circuitry in the lock is powered by one or more batteries housed in a casing associated with the lock, while the keys associated with the lock have no energy source. It is advantageous for the lock to be equipped with a microswitch so arranged that apart from a permanent low-level maintenance supply if necessary, the electronic circuitry of the lock is only connected to its power supply when a key has been fully inserted into the lock so as to close the microswitch, and this supply is cut off by the electronic circuitry in the lock after a delay corresponding to the time required for all the data handling processes that follow the insertion of the key.

The electronic circuitry of the lock comprises a microprocessor programmed to execute the initial sequence of its program when the electric power supply is connected to the circuitry by closing the microswitch, once the key has been inserted, in order to read the lock's customer code and to supply the key with electrical energy. The microprocessor then interrogates the key electronically by comparing the key's customer code with that of the lock, and if the codes are identical, establishes whether the key's identification code is authorized to open the lock or excluded from opening the lock.

Electrical energy is supplied to the key by either transmitting a continuous signal or clock pulses via an electrical connection between the key and the lock, to charge up an energy recuperator.

The reading of the customer code in the lock and the supply of energy to the key take place in parallel, to reduce the overall operation time.

When the comparison of the key's customer code with that of the lock, or when the comparison of the key's identification code with the authorization data stored in the lock's electronic circuitry reveal a mismatch, the microprocessor commands the activation of the electromagnetic blocking mechanism in a bistable mode, and then cuts off the power supply to the lock's electronic circuitry, except if necessary for a low-level permanent maintenance supply.

Before cutting off the supply to the electronic circuitry, the microprocessor ensures that the data have been processed and/or memorized.

If an authorized key is left in the lock for longer than a certain time threshold, the lock's microprocessor is programmed to cut off the power supply to the key and to the lock's electronic circuitry, except for a low-level permanent maintenance supply.

For preference, the electronic and mechanical lock is combined with a system key retained by the lock's manufacturer. This system key does not enable the lock to be opened, but stores electronic data to enable the reprogramming, in the memory of the lock's electronic circuitry, of the customer code constituting the data that correspond to a master-key different from the initial master-key, the new master-key being prepared by the lock's manufacturer and supplied to the user.

Besides, it can be used to reprogram or replace all the "normal" keys.

It is advantageous for the lock to include means of interfacing with a data console and, when the system key has been inserted in the lock and contact has been established between the lock and the said console, for the microprocessor to be programmed to allow some of the data sorted in the memory portion of the lock's electronic circuitry to be used and displayed on the screen of the console, so that at least some parts of the said memory can be reprogrammed from the keyboard of the console. The console in question may be of the "Minitel" type.

The microprocessor may be programmed to allow the data console to be used for control and/or maintenance tests of the lock's electronic circuitry.

Visual and/or sound signals to warn of battery exhaustion may be provided, or indeed, some means of indicating the condition of the batteries.

The electronic lock of the invention may advantageously be of the barrel type with a profiled cylinder, in particular one with a so-called European profile.

The electronic lock will then comprise a sub-assembly including the electronic unit, and the profiled cylinder fitted with an electronic device for blocking the key web. The connection between the electromagnetic web-blocking device, the switch that detects the arrival of the key at the bottom of the barrel and the communication line to the key, on the one hand, and the casing on the other hand, will consist of a flexible cable long enough to allow easy adaptation of the lock assembly to as many door configurations as possible. The connection between the flexible cable and the profiled cylinder has a movable connector at the back of the profiled cylinder some distance away from its end and fitted inside the excess thickness formed by the cover covering the electronic circuitry of the lock, the excess thickness being measured relative to that of the faces of the door associated with the lock to which the cover is fitted.

The casing may be fitted with a screen and several push-buttons provided to authorise or exclude electronic opening by a normal key and/or to display the identification code of a normal key inserted into the lock and/or to deactivate the lock's electronic unit.

The electronic unit may have a clock/date circuit and a memory circuit to memorize inputs, and a microcomputer is specially incorporated in this type of lock and is programmed to emit commands that allow certain keys to be electronically excluded from opening the lock, and to allow setting of the clock, interrogation of the most recent entries, and interrogation and reaction to what the keys are authorized to do, notably in relation to time.

The invention also relates to a key for an electronic lock as defined above, characterized in that it comprises a single contact designed to make electrical connection to an associated contact in the lock, such that all the signals exchanged between the key and the lock are transmitted via this single two-directional line and ground.

The key comprises an energy recuperator intended to be charged from the lock for the supply of the key circuits, a memory circuit, a circuit that decodes the signals received from the lock with regeneration of a clock signal in phase with that of the lock's electronic unit and regeneration of the reading and writing protocols for the said memory circuit, a circuit that decodes the reading and writing protocols, and a message-addition circuit capable of adding the information from the key to a pure clock signal emitted by the lock, such that this message-addition circuit only operates after a reading protocol emitted by the lock.

Besides the components described above, the invention includes a number of other devices which will be explained more explicitly in what follows, in the context of particular examples of its construction described with reference to the attached drawings, but which are not in any way limiting.

DESCRIPTION OF THE FIGURES

Among the drawings.

Finally.

DESCRIPTION OF THE PREFERRED EMBODIMENT

Figure 1:
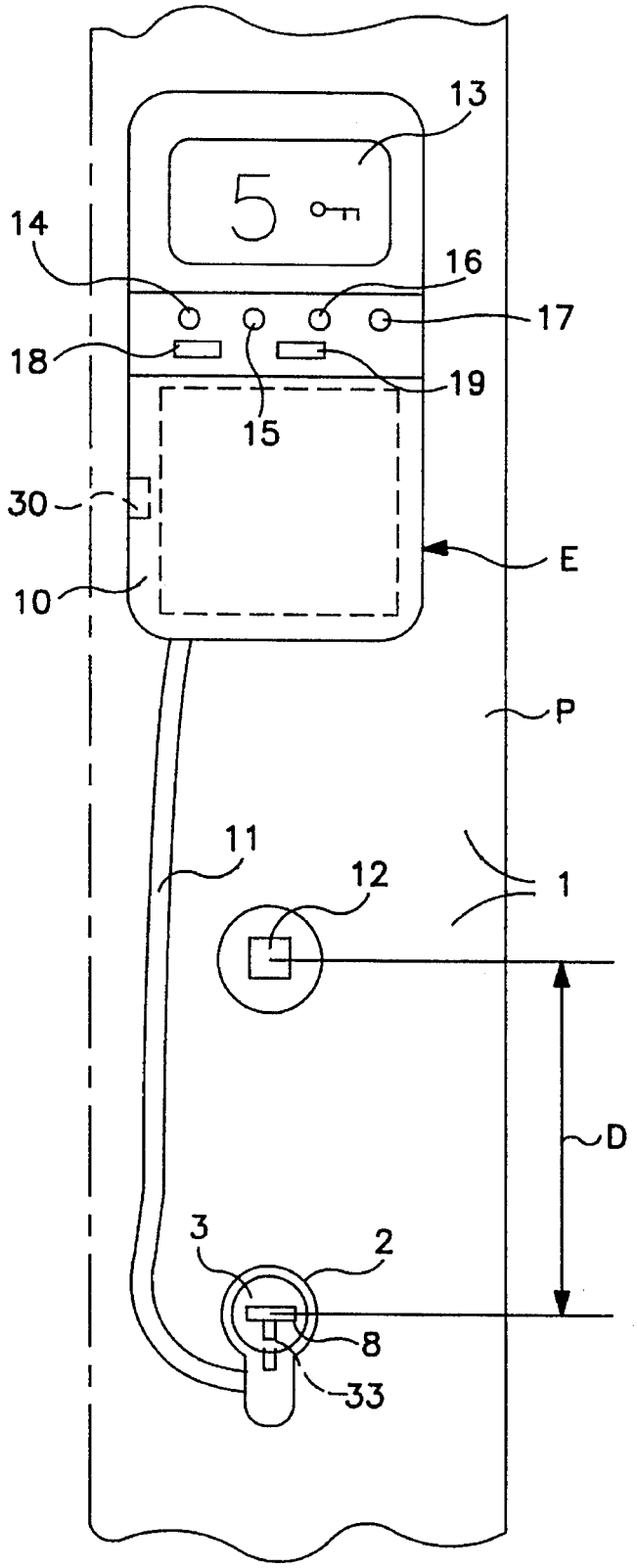
FIG. 1 is a simplified schematic view of an electronic and mechanical lock conforming to the invention, fitted on the interior face of a door.
Figure 2:
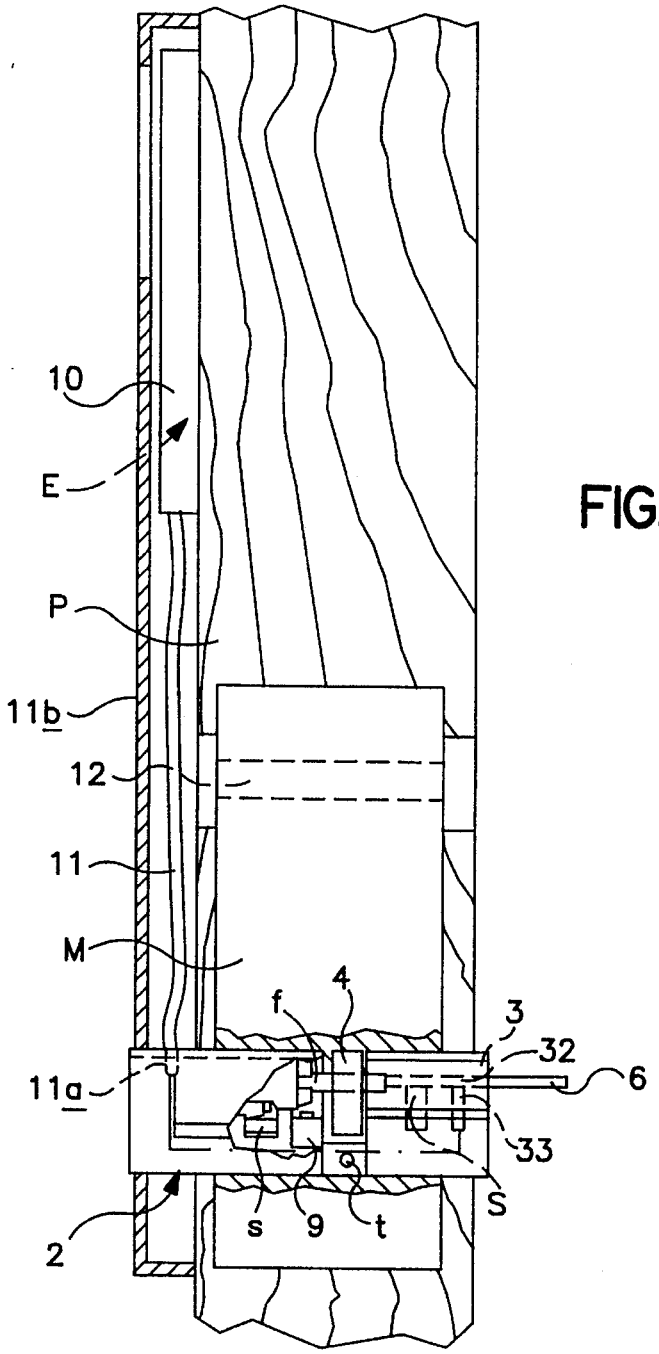
FIG. 2 is a schematic vertical section of the lock shown in FIG. 1.
Figure 3:
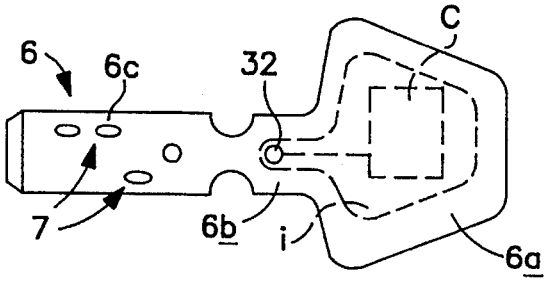
FIG. 3 is a plan view, drawn to a larger scale, of a "normal" key.

Referring to FIGS. 1 and 2, one can see represented schematically an electronic and mechanical lock 1 of the bottom of the range type, conforming to the invention. The lock 1 is of the profiled cylinder 2 type, in particular the European profile which, as can be seen in FIG. 1, comprises an upper circular section extended downwards by a section with parallel faces and rounded at its lower end with an outwardly convex contour. It is known that in this type of lock the profiled cylinder engages by sliding into a mechanism M, which is represented schematically, comprising notably the bolt, which is permanently mounted on the door, in particular by sinking it into the edge of the door. The cylinder is kept in place by a screw t, represented schematically and known as the head-screw. This screw passes through the edge of the door and is parallel to the plane of the door.

The cylinder 2 comprises an external stator and, assembled so that it can rotate within this stator, a rotor 3 that can turn. As the rotor 3 rotates, it carries with it a web capable of activating the mechanism M of the lock so as to move the bolt from an unlocking to a locking position or vice-versa.

The rotor 3 is normally prevented from rotating relative to the stator of the cylinder 2 by a mechanical blocking device 5, advantageously consisting of blades or pins that can move radially with respect to the rotor 3. In a classical way, these blades or pins are spring-loaded so as to block the rotation of the rotor 3. When a suitable key 6 comprising an appropriate mechanical variant 7 is introduced into the slot 8 of the rotor, the fit of the mechanical variant with the various blades or their equivalents displaces these blades radially out of the way, so that the rotor can be turned by means of the key.

The important and classical advantage of profiled-cylinder locks is the possibility of changing the cylinder 2 easily, and with it the mechanical variant, in the event that the key is lost, without having to dismantle the whole of that part of the lock fitted into the door. This advantage is preserved in a lock conforming to the invention.

The lock includes an electromagnetic blocking device 9 fitted in the stator of the profiled cylinder 2. This device can be controlled by the electronic circuitry E of the lock 1 in such a way as to authorize or exclude the rotation of the rotor 3. The electromagnetic blocking device 9 may consist of a mechanism such as a small electromagnet with a mobile core that can take up two positions. In one such position the rotor 3 can be turned normally using a mechanically appropriate key, while when the mobile core is in the other position the rotation of the rotor 3 relative to the stator of the cylinder 2 is blocked. The electromagnetic blocking device 9 is bistable, and remains in position even after the electric power supply has been cut off. Electromagnetic blocking devices of this type are described in the patent application FR 89 16039 mentioned earlier.

The electronic circuitry E of the lock is housed in a casing 10 attached to the interior face of the door P to which the lock is fitted. A flexible cable 11 incorporating multiple conductors is provided to establish electrical connections between the circuitry E and the profiled cylinder 2. This cable 11 is long enough to allow the casing 10 connected to the profiled cylinder 2 to be adapted to numerous lock configurations already in place on a door. In fact, the distance D between the axis of the recess for the profiled cylinder 2 and the axis of a square hole 12 intended for the control of the door by a button or handle, can vary from one type of lock to the next. By making the cable 11 long enough, these variations can be accommodated thanks to the "slack" of the cable 11.

It is immediately evident that the electronic circuitry E in the casing 10 and the cylinder connected to that circuitry by the cable 11 form a sub-assembly that can be adapted directly to a lock already in place on a door, with the profiled cylinder 2 fitted with its electromagnetic blocking device 9 replacing the classical, purely mechanical cylinder.

When the casing 10 has been fitted to the interior face of the door, it is covered by a metallic cover 11*b* shown in FIG. 2, provided with a window, flap, or sliding panel that allows access to the programming devices at the top.

In the design example shown in FIGS. 1 and 2 the casing 10 is provided, at the top, with a screen 13, in particular a liquid-crystal panel, for the display of various data.

Below this screen there are several push-buttons 14–17, i.e. four in the example considered.

Below the push-buttons 14–17 there are two lights 18, 19 of different color, for example green for 18 and red for 19. These may consist of light-emitting diodes (LEDs).

All these elements may be exposed to view or covered by a flap and accessible when the metallic cover 11*b* has been fitted to the casing 10.

The connection between the flexible cable 11 and the profiled cylinder 2 is effected by a movable connector 11*a* at the back of the cylinder profile, some distance away from its end and located inside the excess thickness formed by the cover 11*b*, the said excess thickness being measured relative to that of the faces of the door associated with the lock to which the said cover 11*b* is fitted.

The push-buttons 14–17 are intended to allow the lock's user to perform various functions explained later, notably to enable him to authorize or exclude the opening of the lock by certain keys, while the lights 18 and 19 are intended as warning signals concerning the state of exhaustion of the electric batteries that power the lock's circuits.

Figure 5:
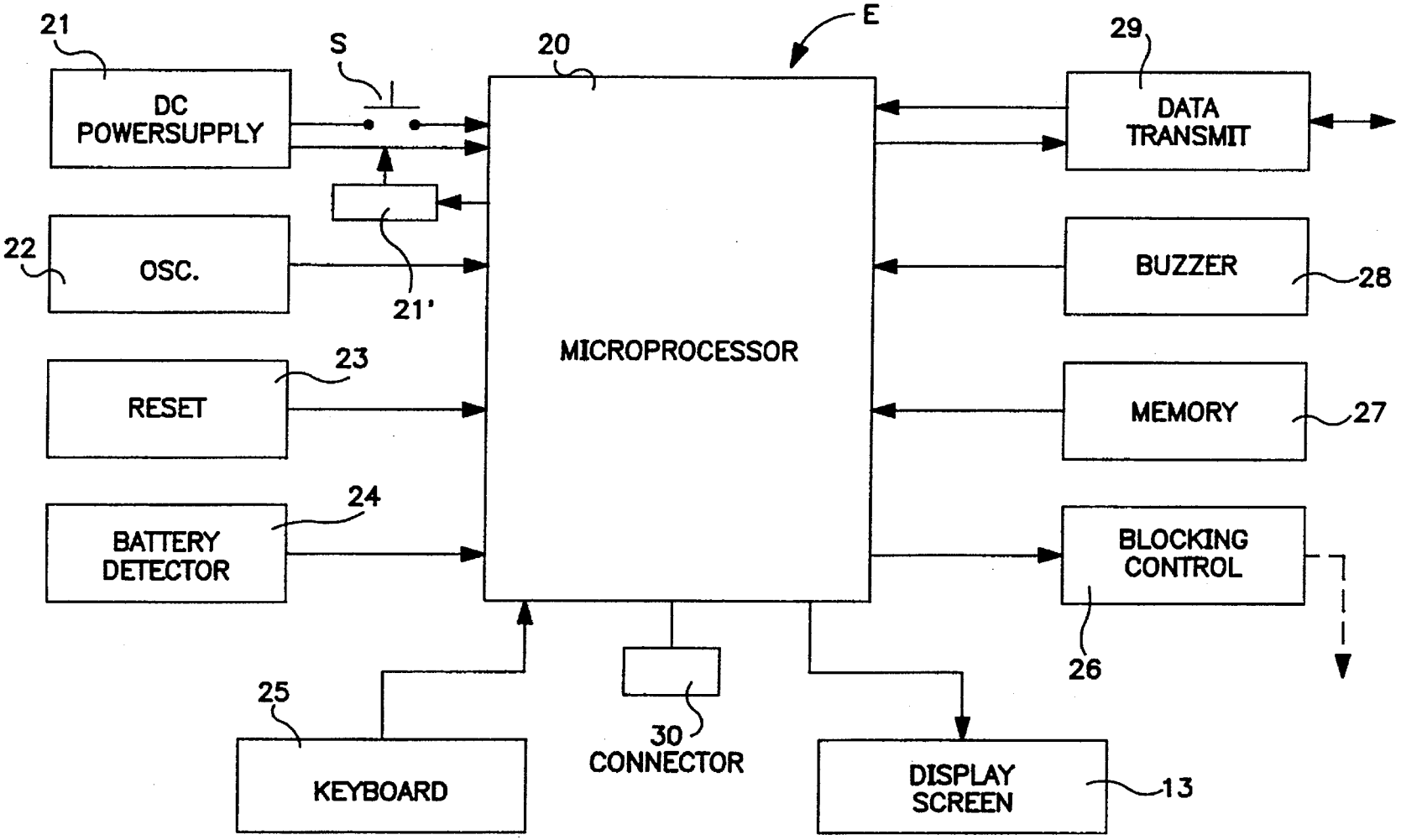
FIG. 5 is a block diagram of the electronic part of a lock conforming to the invention, corresponding to the bottom of the range.

The electric circuitry E is shown as a block diagram in FIG. 5. The circuitry E comprises a microprocessor 20 powered by a supply 21 consisting of an electric battery. A microswitch s is advantageously fitted between the power supply and the microprocessor 20. This microswitch S is normally open, which cuts down energy consumption. The microswitch s only closes when a key has been introduced into the cylinder 2, once the key has been fully pushed in. This microswitch s is fitted inside the cylinder 2.

An oscillator circuit 22 sends pulses to an input of the microprocessor 20.

A reset-to-zero circuit 23 and a circuit 24 for detecting exhaustion of the supply battery are also connected to respective microprocessor inputs.

A keyboard 25 corresponding to the push-buttons 14-17 of FIG. 1 allows the user to input control commands to the memories of the electronic lock.

The screen 13 is connected to an output of the microprocessor 20 to enable visual display of the lock's memories.

A circuit 26 that controls the electromagnetic blocking device 9 is connected to one terminal of the microprocessor 20.

A memory circuit 27 specific to the lock 1 is connected to the microprocessor 20. This memory 27 is used to store a customer code assigned to the user (purchaser) of the lock, and a list of identification codes attributed to keys 6 intended to open the lock.

A buzzer circuit 28 (acoustic warning signal) is connected to one terminal of the microprocessor 20.

Finally, a circuit 29 is connected to the microprocessor 20 to handle the transmission of data between it and a key such as 6.

A supply maintenance circuit 21' is provided to allow an acoustic signal indicating low battery, alarm, etc., after the key has been withdrawn.

The lock 1 comprises means of connection 30, for example consisting of a type-RS 232 socket, to allow interfacing with a data console, for example of the type known as "Minitel".

Figure 4:
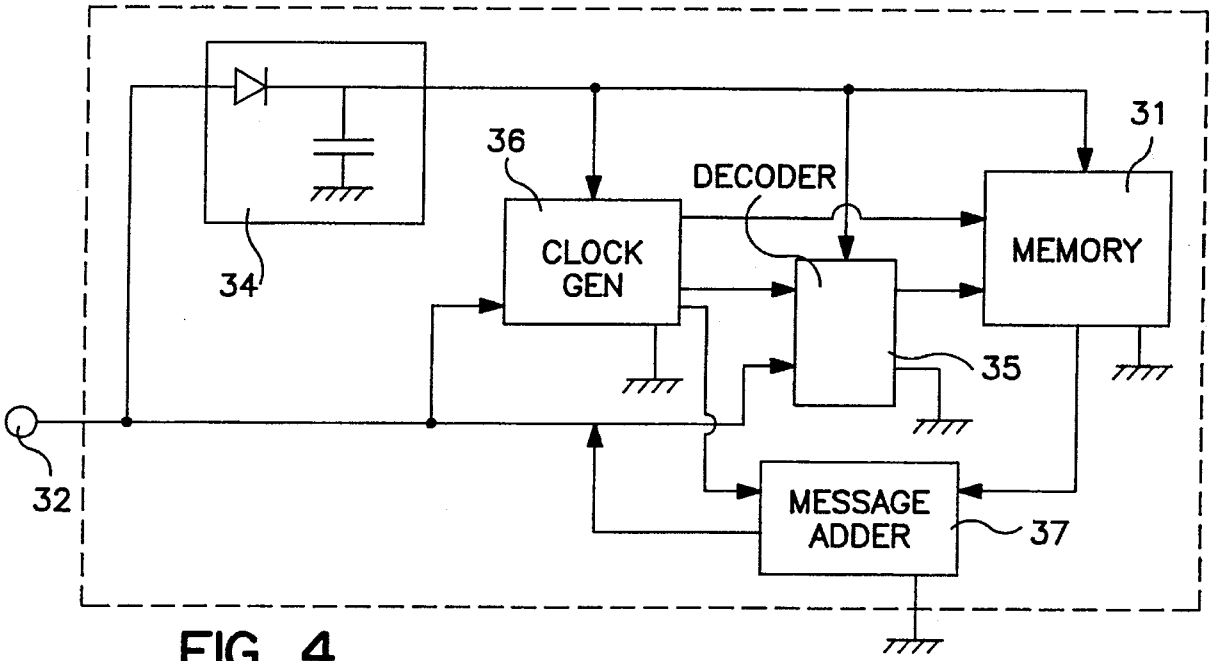
FIG. 4 is a block diagram of the circuitry in a normal key that allows the lock to be opened electronically and mechanically.

The key 6 comprises a group C of electronic circuits illustrated in the block diagrams of FIG. 4, in particular means of storage consisting of an electronic data memory 31 that can be read by the electronic circuitry E of the lock to allow electronic unblocking.

The key 6 comprises a single contact 32 surrounded by insulating material, that can make electrical connection with an associated contact 33 in the lock consisting, for example, of a pin pushed elastically into the slot 8 and able to move back in order to allow entry of the key 6. The pin 33 then rests against the contact 32 and establishes an electrical connection with the key once the latter has been fully introduced. The electronic data exchanged between the key 6 and the lock's electronic circuitry E are transmitted via a single two-directional line corresponding to the contacts 32 and 33 and ground.

A key of this type is envisaged by patent application FR 89 16038 submitted on Dec. 5, 1989 by the same applicant, the company already mentioned.

The key 6, which will be referred to as a "normal key", and which is capable of opening the lock 1, has no battery but an energy recuperator circuit 34 (see FIG. 4). This, for example, comprises a diode and a capacitor, and can accumulate energy from the power supply of the lock 1 when electrical contact is established between the contact 32 and the pin 33.

The output of circuit 34 supplies energy, in parallel, to: the memory 31; a circuit 36 that decodes the signals received from the lock and regenerates a clock signal in phase with that of the lock's electronic circuitry and also regenerates the reading and writing protocols for the said memory circuit 31; and a circuit 35 that decodes the reading and writing protocols. An input to circuit 36 is connected to the contact 32 of the key.

An output from circuit 36, which emits a clock signal, is connected to an input of the memory circuit 31. Another output from circuit 36, with a clock signal, is connected to an input of the decoder circuit 35.

This circuit 35 is also connected to the contact 32 so as to receive data emitted by the lock's electronic circuitry E.

An output from memory 31 is connected to a "message-adder" circuit 37 capable of adding to the pure clock signal emitted by the lock a message corresponding to the data read from the memory 31. This circuit 37, which is also powered by the recuperator circuit 34, only operates after a reading protocol emitted by the lock's circuitry E. Circuit 37 receives clock signals from circuit 36.

Various connections to ground are appropriately located to complete the connection 32–33 between the lock and the key.

The electronic circuitry of the key 6 is imbedded in an insert i made of an insulating material, which fits into the ring 6*a* of the key and extends into the extension 6*b* close to the stem 6*c* of the key, where the contact 32 is situated.

For a "normal" key 6, the data stored in the memory 31 comprise a customer code identical to that of the lock and stored in memory 27, and an identification code specific to the key itself. This identification code may for example be a number.

The various identification codes, in particular the various numbers stored in electronic form, and assigned to each key, are contained in the key-list of the lock's memory 27.

Thus, a set of "normal" keys 6 is formed by a group of keys having in common for the same lock, a given mechanical variant that will enable the lock to be opened and a customer code corresponding to that of the lock. However, each normal key has an identification code specific to itself, that can be authorized to open the lock or excluded from this by the user of the lock, as explained below.

Figure 6:
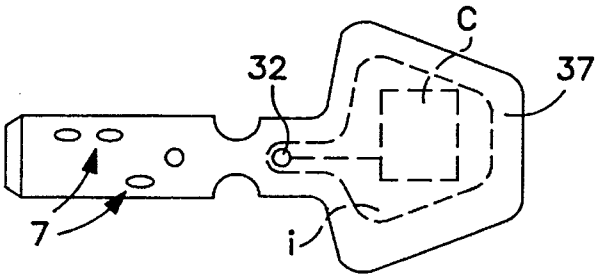
FIG. 6 is a plan view of a master-key.

In addition to the range of normal keys, the user possesses a master-key 37 (FIG. 6).

This master-key 37 cannot be used to open the lock electronically, and its introduction into the cylinder 2 brings about the systematic electronic blocking of the barrel or rotor 3, while ensuring electrical contact between the electronic circuits of the master-key 37 and the circuitry E. The mechanical variant of the master-key 37 is identical to that of the normal keys 6, and the group of electronic circuits C is similar, but the data stored in the memory 31 are different.

These data, stored in the master-key 37, make it possible when the key has been inserted into the lock, for the screen 13 to light up and for the user to program the lock using the four push-buttons 14–17 (at the bottom of the range).

The electronic circuitry E of the lock is designed so that after having inserted the master-key 37, the user can press one of the push-buttons, for example button 14, and thereby increase a key number that appears on the screen 13, or can decrease the number by pressing a different button, for example button 15. By holding down one of the push-buttons continuously, the user can cause the key numbers to change fast enough for a rapid scan.

Suppose that the user has displayed the number "5" on the screen 13, as shown in FIG. 1, corresponding to the normal key that he wishes to program electronically. The lock's electronic circuits E are designed so that by pressing a push-button, for example button 16, the user can either authorize the normal key 6 corresponding to number "5" to open the lock, or exclude it for that purpose.

Advantageously, the circuits E can be programmed so that the state of the normal key corresponding to the number displayed on the screen 13 is indicated explicitly on the screen by lighting up a "logo" that shows at a glance whether the key is authorized or excluded. In the example of FIG. 1, the "logo" situated to the right of the number "5" is a schematic representation of a key and corresponds to the state of having been authorized. It would be possible to supplement the "logo" with the letters OK to the right of the key.

Figure 8:
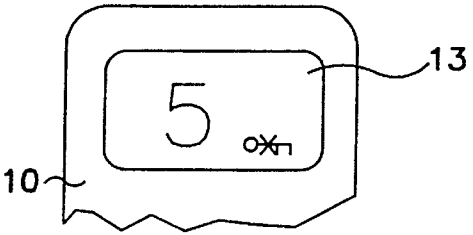
FIG. 8 is a view of a detail of the screen in FIG. 1, corresponding to an excluded key.

Starting with that state, if the user now presses push-button 16 he will command the exclusion of key "5", in which case the "logo" will be altered as shown in FIG. 8. The exclusion "logo" is a schematic key with a cross superimposed on it, situated to the right of the number "5".

By pressing button 16 yet again, the user would again authorize key "5" to open the lock.

Thus, with the help of the master-key 37 which he alone holds, the user can very simply program the authorization or exclusion of normal keys 6 to open the lock electronically.

In particular, should a normal key 6 be lost, the user can at once exclude that key from opening the lock electronically by displaying its identification code on the screen 13 and excluding that code. A different normal key, with a different electronic number (identification code), will then be authorized to open the lock and can be issued as a replacement for the lost key.

The microprocessor 20 is programmed to allow the user to inhibit the electronic function of the lock by pressing the fourth push-button 17 while the master-key 37 is inserted in the lock. For preference, a blinking "logo" appears on the screen 13 so as to attract the user's attention to the fact that the electronic function has been inhibited. If the master-key 37 is then withdrawn from the cylinder 2, the lock remains in the state of electronic inhibition and the normal keys 6 can then be used to open the lock on the basis of the mechanical variant 7 alone.

Should the electric battery powering the lock run down, the insertion of any authorized key 6 into the cylinder 2 will activate a specific acoustic signal produced by circuit 28, to warn that the battery must be replaced.

The battery's state of charge can be checked at any time, from outside the casing 10, by pressing a push-button (not shown) that lights up one of the two LEDs 18 (green = battery still good) or 19 (red= battery exhausted).

The microprocessor 20 is programmed to ensure that all the various circuits are re-set to zero once the microswitch s is closed when a normal key 6 has been fully inserted, and to read, as a first step, the customer code of the lock 1 and at the same time supply the key 6 and its energy recuperator 34 with electrical energy, by transmitting sometimes a continuous signal and sometimes clock pulses to the electrical connection 32–33 between the lock and the key 6. The microprocessor 20 is designed so that it will then proceed with the electronic interrogation of the key 6 in order to compare its customer code with that of the lock 1, and if the two codes are identical, to establish whether the identification code of the key 6 is authorized to open the lock or excluded from this.

The operating sequence of the lock 1 is as follows.

Starting from a position when the door P is closed, a key is inserted from the outside with the intention of opening the door. In fact, the electronic function of the lock can be restricted to commands from the outside, which is the side from which protection is most important.

The key 6 is inserted into the rotor of the cylinder 2. When fully introduced, the key 6 activates the microswitch s which connects the power supply to the lock's electronic circuitry E. It should be noted that if needs be, a permanent low-level maintenance supply can be provided even when microswitch s is open. The microswitch s can be operated by a pushing mechanism f (FIG. 2), which slides across the web 4 and is moved by the tip of the key 6 when fully inserted.

The electronic circuitry does not come to life instantly, but requires three to ten milliseconds for the operation of resetting to zero.

After this re-setting to zero phase, the microprocessor 20, appropriately programmed, will carry out the following operations simultaneously, i.e. in parallel for the sake of time optimization:

the customer code of the lock 1 in the memory 27 is read;

the key 6 is supplied with energy by transmitting sometimes a continuous signal, sometimes clock pulses via the connection line passing through the pin 33 and the contact 32, to allow the energy recuperator circuit 34 and its capacitor to accumulate enough electrical energy to power the various circuits of the key 6.

To the clock pulses, the microprocessor 20 adds a message (protocol) to interrogate the memory 31 of the key 6.

In response, during the off periods of the clock pulse times, the key 6 transmits to the microprocessor 20 the customer code stored in its memory 31 and its own identification code, consisting of a key number in the example envisaged.

The microprocessor 20 compares the customer codes of the lock 1 and the key 6.

If the codes are different, the microprocessor 20 emits a command to block the lock electromagnetically. Thus, the electromagnetic blocking device 9 is not in principle supplied with electrical energy and its activation only takes place when it becomes apparent that the key introduced is not electronically authorized. This results in a saving of energy. Thanks to the time optimization, the system reacts very rapidly to command an electromagnetic block when a key not authorized electronically is inserted. The electromagnetic blocking device 9 has two bistable positions, and a single electric pulse is needed to move the core from one position to the other, where it will remain even if the power supply is cut off.

If the customer codes of the lock 1 and the key 6 are identical, the microprocessor 20 reads the memory 27 at the address corresponding to the number of the key introduced. Depending on the data contained in that memory cell of a single bit (for example bit= 0), the microprocessor 20 will command the electromagnetic blocking of the barrel 3 by sending an electric pulse to the blocking device 9, or alternatively (bit=1), the microprocessor 20 will not call for the electromagnetic blocking of the cylinder 2, and will confirm that the key is authorized by an acoustic "beep" emitted by circuit 28.

If the key 6 has not been withdrawn from the cylinder 2, the microprocessor 20 will cut off the power supply to the key 6 and the other peripherals. This avoids discharge of the battery in the lock 1 by any ill-intentioned person who might try to produce a short-circuit between the lock's contact pin 33 and ground.

To program such a sequence into the microprocessor 20 has several advantages.

The rotor 3 is continuously unblocked in the electromagnetic sense, which avoids problems in the event of battery exhaustion. To be sure, the electronic security is lost, but the mechanical security remains and the user is not locked out of his own premises.

The part which consumes most energy is the electromagnetic blocking device 9 (electromagnet). A considerable saving of energy is achieved by the facts that this electromagnet is not powered continuously, and that whenever a correct key is used, it is never powered at all.

The fact that the lock's electronic circuitry is activated by the microswitch s also results in an appreciable saving of energy, since the circuits are not powered, or only at low level, throughout the periods when they are not required to be active; periods which are, of course, much longer than those during which the circuits are required to be active.

The key 6 has no battery, and this avoids any risk that the power supply to the key may fail.

The data exchange between the lock 1 and the key 6 takes place along a single line and to ground. There is only one connection to be made, between the pin 33 and the contact 32, and this results in increased reliability. The key's single contact 32 allows more room on the extension between the ring and the stem of the key.

There is also more room at the level of the contact system, thanks to the single pin 33 in the cylinder 2. The wiring is less dense inside the cylinder 2.

The ground contact consists of the metallic parts of the key and the barrel. Besides simplifying the wiring, this protects the line against parasitic signals by locating the ground concentrically around the line.

All these advantages combine to make the system quite compact. This makes it possible to retain the European profile for the cylinder 2, and to ensure compatibility with exterior covers and conventional locks.

Figure 7:
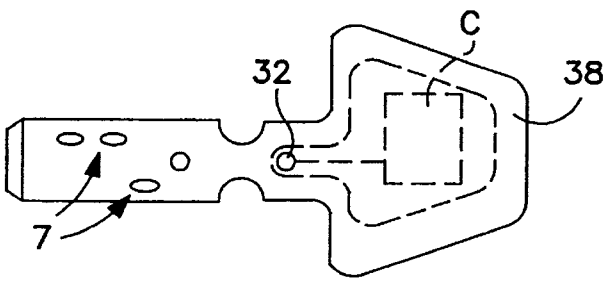
FIG. 7, similar to FIG. 6, shows a system key.

The lock 1 is also combined with a system key 38 (FIG. 7) retained by the lock's manufacturer.

This system key does not possess the same mechanical variant as a normal key. It comprises electronic circuits C similar to those shown schematically in FIG. 4, but the data contained in the memory 31 of the system key 38 cannot be used for the electronic opening of the door (as was the case with the master-key).

The electronic data stored in the memory 31 of the system key is present in order to allow a master-key different from the initial master-key to be programmed into the lock memory 27. In particular, in the event that the initial master-key 37 has been lost, a new master-key 37 can be established by the lock's manufacturer, with a new customer code, and supplied to the owner.

To effect these changes the lock manufacturer acts at the level of the lock 1, to program new data and in particular a new customer code into the lock's memory 27. It should be noted that these operations can only be performed by the manufacturer from inside the area protected by the lock. In other words, the manufacturer can only make such changes in the presence or with the authority of the lock's user.

The lock manufacturer uses data socket 30 to connect a data console, for example the one known as "Minitel".

The microprocessor 20 of the circuitry E is programmed to react to predetermined commands emitted by the console connected to the socket 30 (these commands may be very simple, even consisting of a single touch on a predetermined key of the console's keyboard), to allow the following:

visualization of the customer code currently stored in the memory 27;

modification of this customer code;

performance of maintenance operations, since part of the microprocessor 20 is programmed to allow the testing of several electronic functions of the circuitry, such as the functions of reading and writing from or to the memory; testing the mono-contact with the key; testing the RS 232 interface with the "Minitel" console; testing that the push-buttons 14–17 operate correctly, etc. . . .

The sequence of maintenance tests may take place automatically.

It should be noted that the system key 38 is so designed that it cannot be used to carry out the functions reserved for the master-key 37 held by the user of the lock.

When the above operations have been performed using the system key 38, the old keys 6 and the old master-key 37 are no longer suitable from an electronic standpoint, and are replaced by a new set of keys supplied by the manufacturer to the user. These new keys will have the same mechanical variant as their predecessors, but will contain different electronic data.

If needs be, the manufacturer can reprogram all the old keys.

The above explanations show clearly that it is extremely simple to modify the lock 1 since this is done electronically and there is no need to dismantle or change the lock fitted to the door. Only the keys have to be replaced.

The electronic and mechanical lock 1 of the invention offers numerous possibilities in relation to the programming of pass-key plans, for example for the various doors of a building or hotel.

Two basic schemes are possible.

A first scheme consists in adopting a given mechanical variant for the various locks in a building, but with different electronic variants.

A second scheme consists in adopting different mechanical variants from one lock to the next, but with a common electronic variant.

From these two basic schemes, various compromises can be achieved that combine the two schemes.

Figure 9:
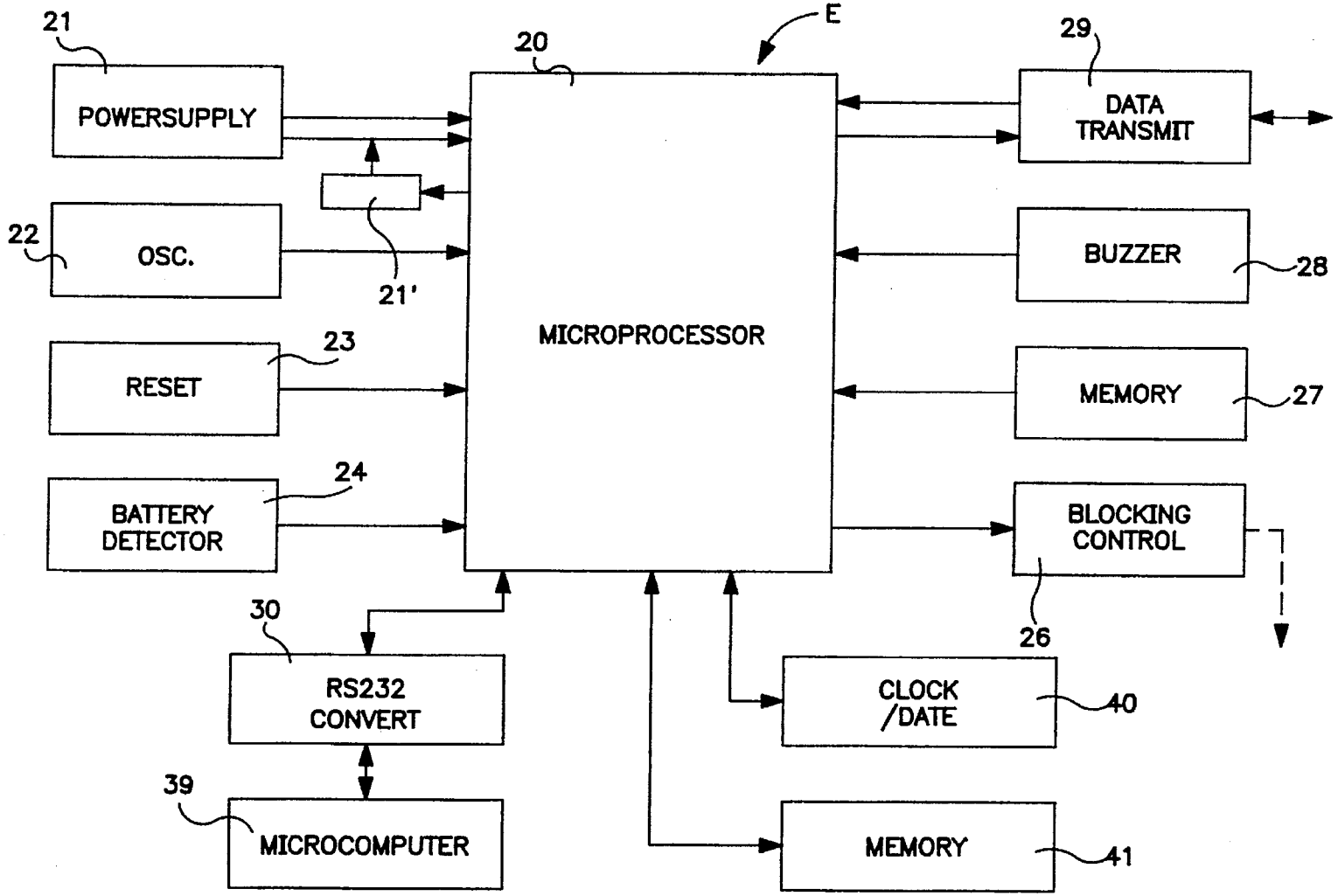
FIG. 9 is a block diagram of an electronic lock conforming to the invention, corresponding to the top of the range.

FIG. 9 shows the block diagram of the electronic circuitry in a top-of-the-range electronic and mechanical lock.

The electronic circuitry E of this lock is contained in a casing similar to casing 10 in FIG. 1, but which may no longer have a screen 13 or push-buttons 14–17. In contrast this casing is still fitted with a type RS 232 connection socket 30 intended to allow connection this time, no longer to a simple "Minitel" console as in the bottom-of-the-range lock, but to a microcomputer 39 specially assigned to the lock and programmed to transmit commands to the microprocessor 20, to enable:

certain keys to be electronically excluded from opening the lock, which corresponds in some way to the function of push-button 16 on the lock of FIG. 1;

the setting of a clock 40 that forms part of the lock's electronic circuitry, to date the various operations carried out:

interrogation of the most recent entries, with indication of the identification code of the keys used to open the door during those entries:

interrogation of the authorizations given to the various keys.

The electronic circuitry of the top-of-the-range lock shown in FIG. 9 thus comprises, in addition to the circuits already described with reference to FIG. 5 and designated by the same numerical identifiers, the clock/date circuit 40 just mentioned and a memory circuit 41 to memorize the entries (openings of the door) by storing:

the electronic identification code (number) of the key inserted;

the date and time when the key was inserted.

The microcomputer 39, which is put at the disposal of the lock's owner, makes it possible to react to what the keys are authorized to do, notably in relation to time.

All the advantages described with reference to the bottom-of-the-range lock are of course preserved in this top-of-the-range lock, which still works with normal keys 6, a master-key 37 and a system key 38 that carries out the functions already explained.

I claim:

1. A locking device comprising:

a mechanical lock operable with a key, said mechanical lock including an electrical contact for contacting with an electrical contact on said key;

an electrical lock which is controlled by an electrical signal;

electrical circuit means for generating said electrical signal for operating said electrical lock comprising:

(a) a memory for storing the identity of each key which is authorized to operate said mechanical lock;

(b) a microprocessor for reading the contents of said memory;

(c) a power supply for supplying an operating current to said memory and microprocessor; and, (d) an interface for connecting said electrical contact of said mechanical lock to said microprocessor whereby said microprocessor can communicate with an electronic circuit on said key and compare data supplied by said key with data stored in said memory and supply said electrical signal to said electrical lock in response to said data comparison, wherein said electrical lock is placed in a locking state when said microprocessor detects a mismatch between data supplied by said key and data stored in said memory, and said electrical lock remains in said locking state without providing any subsequent electrical current to said electrical lock;

a master key which can be inserted in said mechanical lock, which does not operate said mechanical lock, for programming said electrical circuit means comprising:

an electrical contact which contacts said mechanical lock contact when said master key is inserted in said mechanical lock, a data circuit for supplying said data to said memory identifying each key of a set of keys which can operate said electrical lock; and a first set of keys which operate said mechanical lock and have an electronic circuit which contains a unique number corresponding to a number stored in said memory, said first set of keys including a contact member which contacts said mechanical lock contact when it is inserted in said mechanical lock, receiving an operating voltage from said electrical circuit means and supplying said number to said microprocessor so it can be compared with numbers stored in said memory to operate said electrical lock.

2. The locking device according to claim 1 wherein said mechanical lock includes a microswitch operated by a key inserted in said mechanical lock to supply an operating current to said electrical circuit means, and for inhibiting current to said electrical circuit means when said key is removed.

3. The locking device of claim 2 wherein said microprocessor is programmed to execute a sequence of steps which reads data from a key of said set which has operated said microswitch when said key is inserted in said mechanical lock, and supply said electrical current to said electrical lock when a number supplied by a key agrees with a stored number in said memory.

4. The locking device of claim 3 wherein said microprocessor disables a full operating current to said electrical circuit means when said microprocessor has completed its programmed execution following closure of said microswitch.

5. The locking device according to claim 3 wherein said microprocessor is programmed to disable full operating current to said electrical circuit means after a predetermined lapse of time following insertion of a key.

6. The locking device according to claim 1 further comprising a maintenance port on said electric circuit means for communicating with a data console to permit said microprocessor to be programmed when enabled by said master key inserted in said mechanical lock.

7. The locking device according to claim 1 wherein said electrical circuit means further comprises a display device which displays data supplied from a key of said set of keys inserted in said mechanical lock.

8. The locking device according to claim 7 further comprising programming switches connected to said electrical circuit means for programming said microprocessor in conjunction with said display device to authorize or de-authorize said keys of said set of keys to open said locking device.

9. The locking device according to claim 1 wherein said mechanical lock is a barrel type, having a profiled cylinder, and said electrical lock comprises an electromagnetic actuator for rendering a rotor of the mechanical lock inoperable until an electrical signal is supplied to said electromagnetic actuator to unblock said rotor, said electromagnetic actuator being connected to a remotely located electrical circuit means via a flexible cable.

10. The locking device of claim 1 wherein said set of keys includes an electronic circuit which includes a memory for storing identification data, a circuit for decoding signals received from said electrical circuit means microprocessor and for regenerating a clock signal, a circuit for regenerating reading protocols for reading data from said electronic circuit memory, and a circuit for adding data read from said electronic circuit memory to a clock signal emitted from said electrical circuit means whereby said read data is transferred to said electrical circuit means microprocessor.

* * * * *